United States Patent [19]

Kenk et al.

[11] 3,970,115

[45] July 20, 1976

[54] DEVICE FOR MONITORING THE YARN TRAVEL IN THE SHUTTLE OF A SHUTTLE LOOM

[75] Inventors: Erhard Kenk, Vaihingen; Theo Kenk, Karlsruhe, both of Germany

[73] Assignee: Aktiengesellschaft Gebruder Loepfe, Wetzikon, Switzerland

[22] Filed: May 16, 1975

[21] Appl. No.: 578,213

[30] Foreign Application Priority Data

May 25, 1974 Germany ..... 2425437

[52] U.S. Cl. ..... 139/371; 139/370.1; 28/51; 66/163

[51] Int. Cl.[2] ..... D03D 51/34

[58] Field of Search ..... 139/371, 370 R, 370 A; 28/51; 57/81; 66/163; 310/8

[56] References Cited

UNITED STATES PATENTS

| | | | |
|---|---|---|---|
| 3,298,401 | 1/1967 | Stutz | 139/371 |
| 3,433,273 | 3/1969 | Loepfe | 139/371 |
| 3,467,149 | 9/1969 | Dosch et al. | 139/371 |
| 3,593,756 | 7/1971 | Vella | 139/371 |
| 3,613,744 | 10/1971 | Dosch et al. | 139/371 |
| 3,676,769 | 7/1972 | Loepfe | 139/370 R |
| 3,802,469 | 4/1974 | Loepfe | 139/371 |

FOREIGN PATENTS OR APPLICATIONS

| | | | |
|---|---|---|---|
| 1,498,049 | 9/1967 | France | 139/370 A |
| 1,535,398 | 9/1970 | Germany | 139/370 A |
| 1,184,583 | 3/1970 | United Kingdom | 139/371 |

OTHER PUBLICATIONS 1,535,398, 9–3–1970, German Application (Engels) 139–370 A

*Primary Examiner*—James Kee Chi
*Attorney, Agent, or Firm*—Werner W. Kleeman

[57] ABSTRACT

A device for monitoring the travel of a yarn, particularly weft yarn in the shuttle of a loom, which device is designed as an assembly or unit comprising a piezoelectric transducer element, a yarn feeler member fixedly bonded with the transducer elements and arranged as a unilaterally clamped flexural vibratory member, and an induction coil operatively connected with the piezoelectric transducer element, and wherein a yarn guide means is provided at or near the free end of the vibratory yarn feeler member such that the yarn when traveling acts upon said feeler member in a restricted area thereof.

11 Claims, 7 Drawing Figures

DEVICE FOR MONITORING THE YARN TRAVEL IN THE SHUTTLE OF A SHUTTLE LOOM

BACKGROUND OF THE INVENTION

The present invention relates to a new and improved device for monitoring the yarn travel in the shuttle of a loom, the shuttle being provided with a threader, said device comprising an assembly which includes a piezoelectric transducer element, a yarn feeler member mechanically coupled with the piezoelectric transducer element, an induction coil operatively connected with said transducer element and elastic supporting means. Generally, such a device is intended for stopping the loom when the yarn breaks or ceases to travel on its predetermined path in the shuttle.

U.S. Pat. No. 3,467,149 and Swiss Pat. No. 441 172 disclose electronic devices for surveying the presence of weft thread in a shuttle loom which comprise a piezoelectric signal generator including a coil and arranged in the shuttle, and a detection circuit including a further coil arranged along the path of the shuttle movement. As shown in said United States patent, the shuttle is formed with a hollow central chamber, within which is mounted a weft bobbin. The weft thread to be supplied by the shuttle is wound about the bobbin and is played out from the front end of the bobbin. The thread passes over the signal generator near the front of the shuttle; and then it leaves the shuttle via an output guide. The bobbin is supported at the rear thereof by means of a bobbin support within the hollow chamber.

The signal generator is mounted within the hollow chamber toward the front thereof by means of rubber bearings which serve to isolate the signal generator from vibratory effects within the shuttle. The signal generator itself includes a base member mounted between the rubber bearings. A wire-like thread feeler element is mounted on the base member and extends to a position such that the weft thread must rub across the feeler element as it is drawn off from the bobbin and moves toward the output guide.

The wire-like thread feeler element is mounted in cantilever fashion at one end to extend upwardly from the base member. The thread feeler element then bends over to extend transversely across and above the base member. The base member, the weft bobbin, and the output guide are all positionally related such that the weft thread presses slightly downwardly upon the thread feeler element toward its free end and rubs across the element during its movement from the bobbin toward the output guide. An elongated piezoelectric crystal is supported at each end thereof by means of mounting elements to extend horizontally above the base member just under the thread feeler element. A vibration coupling member interconnects the thread feeler element and the piezoelectric crystal at a point midway between the two mounting elements.

A signal generator coil is wound about the periphery of the base member. This coil acts as an antenna for controlling electromagnetic field interaction between the moving signal generator and the stationary signal receiver as the shuttle passes closely over the signal receiver. Various other electrical components are embedded within the base member and are electrically connected with the signal generator coil and the piezoelectric crystal.

In said United States and Swiss patents no details are disclosed about the disturbances influencing the piezoelectric signal generator from outside the shuttle, and the enormous accelerations the shuttle undergoes when the loom is working and which imply very serious problems. This refers particularly to the impacts acting upon the shuttle when driven or stroken by the picker, further to the intense noise existing in weaving sheds, and to the vibrations generated by the operating loom which may be transferred to the shuttle. By such influences the signal generator may be damaged or even rendered inoperative, or wrong electrical signals may be generated in the sensitive signal generator or other components of the monitoring equipment which cause unwanted stops of the loom.

A further problem results from spurious electrical signals from the surroundings of the loom or the electric supply which may cause trouble by inductive effects on the induction coils of the signal generator and detecting circuit arranged at the loom.

A further rather difficult problem is the arrangement and accommodation of the signal generator in the front end of a conventional weaving shuttle without adding to the dimensions of the shuttle. Any enlargement of the width, height and/or length of the shuttle might necessitate structural changes on the loom and thus would be impracticable.

SUMMARY OF THE INVENTION

It is a primary object of the invention to provide a piezoelectric yarn travel monitoring or sensing assembly which is rugged and insensitive to undesired interferences of any kind, and particularly an assembly mounted in the shuttle of a loom of such construction and arrangement as to avoid the problems mentioned in the foregoing context.

It is a further object of the invention to provide a piezoelectric yarn travel monitoring unit which is of improved design and function relative to prior units of similar destination, in such a manner as to be suitable for permanent practical use in weaving mills.

Another more specific object of the invention is the provision of a piezoelectric yarn travel sensing unit which can be easily mounted in the shuttle of a weaving loom and which can be easily replaced by another similar sensing unit.

In order to implement the aforementioned objectives and others which will become more readily apparent as the description proceeds, the piezoelectric yarn travel monitoring device of the invention is generally characterized by the improvement that

- the induction coil is disposed in an area beneath the threader in a cutout of the shuttle;
- that the yarn feeler member and the piezoelectric transducer element are directly connected with one another; and
- that the yarn feeler member is arranged as a unilaterally clamped flexural vibratory member having a free end which is in contact with the traveling yarn.

The notation — directly connected with one another — is to be understood such that the yarn feeler member which preferably has the shape of a sheet of metal is connected fixedly and without using an intermediate or coupling member with the piezoelectric transducer element. Such coupling members which normally consist of elastic material, as rubber, usually imply damping losses to the vibrating system and thus attenuation of the signal indicating the yarn travel.

In the aforementioned prior electronic weft thread surveying device, a damping coupling member is provided between feeler member and transducer element, and, moreover, the traveling weft thread does not act upon the feeler member at a well defined location and with well defined power arm since the weft thread traverses along the feeler member over a length section thereof. Thus, the leverage changes permanently with the traveling weft so that excitation of a well defined vibratory mode is questionable.

Omitting the coupling member and shaping the inventive yarn feeler member as a clamped-free flexural member provides for a mechanical vibratory system having a well defined resonant frequency and high Q. Moreover, guiding the yarn over the free end or a defined location near the free end of the yarn feeler member ensures the latter to be excited by the traveling yarn with well defined leverage and thus with high efficiency in its resonant mode. The inventive monitoring assembly or unit may be arranged in the shuttle such that the yarn feeler member is located in the area of the threading slot of the threader and immediately in front of the latter. Preferably the yarn feeler member is provided with an aperture or recess at its free end which serves as a yarn guide. Another embodiment of the invention consists in arranging the induction coil on a bolt protruding from the threader in downward direction and through a central hole of the coil and securing it to said bolt by means of a locking member. Preferably elastic means, as rubber washers, are placed between coil and adjacent parts of the shuttle and coil fixing means.

A further advantageous embodiment consists in a ring or receptacle of elastic material, as rubber, receiving the induction coil and engaging at its circumference a peripheral groove in the shuttle body. In the free space of the shuttle a transverse wall may be provided connecting the inner walls of the shuttle and arranged near the induction coil such as to protect the latter and the transducer element from damage when the weft bobbin is changed in a faulty manner. Another inventive improvement consists in providing the threader at its end facing the weft bobbin and the yarn feeler member with at least one projection protruding over said feeler member and protecting it from damage.

BRIEF DESCRIPTION OF THE DRAWINGS

The invention will be better understood and objects other than those set forth above will be apparent upon consideration of the following detailed description thereof which makes reference to the annexed drawings wherein.

DETAILED DESCRIPTION OF THE PREFERRED EMBODIMENTS

Figures 1, 2, 3, 4, 5, 6, 7:
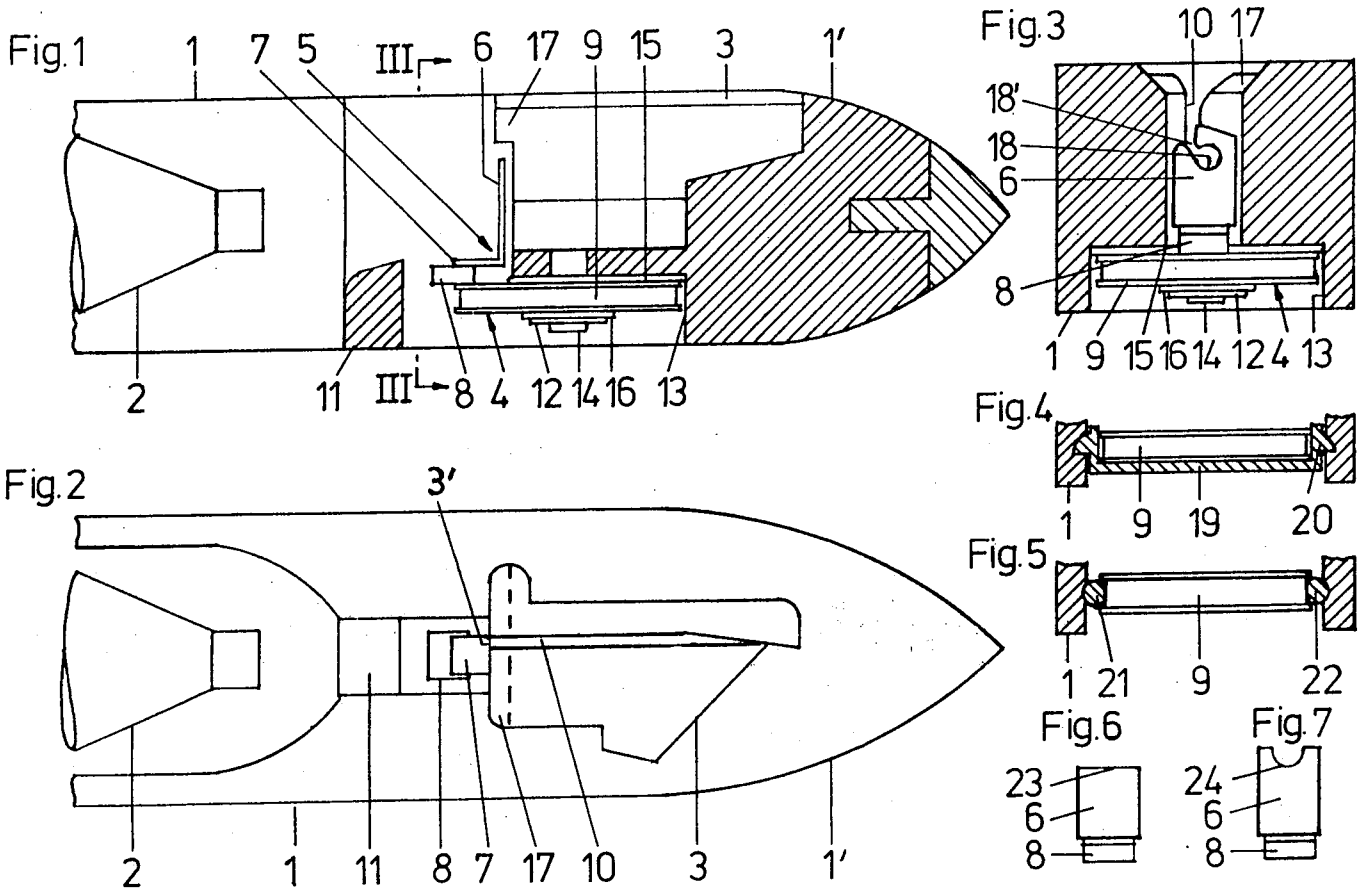
FIG. 1 shows a vertical longitudinal section of one end of a shuttle provided with a threader and a sensing insert.
FIG. 2 is a plan view of the shuttle end shown in FIG. 1.
FIG. 3 is a cross section taken along the line III—III in FIG. 1, FIGS. 4 and 5 show two alternative embodiments of the means for supporting the sensing insert in the shuttle.
FIGS. 6 and 7 are front views of two modified embodiments of the yarn feeler member.

With reference to FIGS. 1 and 2, a weft bobbin 2 and a threader 3 having a threading slot 10 are located in the front end 1′ of a shuttle 1 which may be of conventional design. A sensing assembly or insert 4 comprises a yarn feeler member 5, a piezoelectric transducer element 8 and an induction coil 9, which components are interconnected rigidly, i.e. without using intermediate members of elastic material. As shown particularly in FIGS. 1 and 3, induction coil 9 is placed in a cutout 13 of shuttle 1 underneath threader 3. Induction coil 9 is provided with a central hole (not shown) which receives a bolt 14 protruding downwards from threader 3, and a releasable locking ring 12 is provided at bolt 14 to fix induction coil 9 thereto. Shock and vibration absorbing washers 15 and 16 of elastic material, as rubber, are provided adjacent the two major parallel faces i.e. the top and bottom faces, respectively, of induction coil 9 and the thereto parallel adjacent faces of cutout 13 and locking ring 12, respectively. Thus, the flat major faces of induction coil 9 are arranged in parallel relationship to the bottom face of shuttle 1 and to the top face of the not shown sley beam. In order to suppress still more completely impacts and vibrations which might be transferred to sensing assembly 4, a bushing of elastic material (not shown) can be placed on bolt 14 within the central hole of induction coil 9, so that the latter is mounted in shuttle 1 by means of elastic material interposed at all its supported faces.

As shown in FIG. 1, the top face of induction coil 9 is covered to some extent by the body of shuttle 1 below threader 3. On the exposed top face of induction coil 9 piezoelectric transducer element 8 which may be plate-shaped is mounted with one of its plane surfaces connected directly, i.e. without using an intermediate member of elastic material, to said top face. Yarn feeler member 5 which may be a metal sheet or strip bent to an L-shaped configuration is also connected directly to the top face of transducer element 8. The components 5, 8 and 9 may be bonded together, e.g. by means of an epoxy resin adhesive. The lower clamped or fixed arm 7 of yarn feeler element 5 is parallel to the top face of induction coil 9, whereas the free arm 6 which is intended to contact and sense the weft thread is perpendicular to said top face and extends in a direction at right angles to the mean path of the weft thread which extends between the tip of weft bobbin 2 and threading slot 10.

Transducer element 8 is provided at its top and bottom surfaces with metal electrodes (not shown) which are connected with the winding of induction coil 9 by leads (not shown). As may be seen from FIGS. 1 and 3, induction coil 9, transducer element 8 and yarn feeler member 5 are joined to a structural unit or assembly which may be easily removed from cutout 13 and bolt 14 after detaching locking ring 12, and replaced with another similar unit.

Specific measures may be taken for protecting the sensing insert 4 from undesired physical contact with other parts. Thus, in the inner space of shuttle 1 a transverse wall 11 may be provided which extends in a vertical direction from the bottom face of shuttle 1 to a level above the top face of transducer element 8. Transverse wall 11 protects transducer element 8 and induction coil 9 from being hit by the tip of weft bobbin 2 when changing the latter. Additionally, along the upper edge of threader 3 facing weft bobbin 2 a projection 17 protruding over the free end 6 of yarn feeler member 5 is arranged for shielding this member from mechanical actions from the upper side of the shuttle. Moreover, yarn feeler element 5 is located immediately at the thread inlet 3′ of threader 3 so that its free part 6 is placed safely in a recess formed by threader 3 and the adjacent walls of shuttle 1.

FIG. 3 shows the flat free part 6 of yarn feeler member 5 as seen from the side of weft bobbin 2. At the upper end of said free part 6 a thread guide 18 is provided. This thread guide is formed as an aperture or eye, with an open threading slit 18'. When the loom is working, the traveling weft thread guide 18 continuously so that the edges thereof are worn only slightly and at a uniform rate.

With reference to FIGS. 4 and 5 two modified embodiments of the means for supporting sensing insert or assembly 4 in shuttle 1 are shown wherein induction coil 9 is arranged in a similar position as in FIGS. 1 and 3, however, in a circular cutout of the shuttle. In FIG. 4, induction coil 9 is fittingly received in an open circular receptacle 19 consisting of elastic material. Receptacle 19 is provided with a peripheral flange 20 engaging a circumferential groove in the front end 1' of shuttle 1. Thus, induction coil 9 and the whole of sensing assembly 4 are supported elastically and shockproof, and, moreover such as to be easily replaceable. In FIG. 5, induction coil 9 is fitted tightly in a peripheral bearing ring 21 of elastic material, as rubber, engaging a circumferential groove 22 in shuttle 1 such as to support sensing insert 9 elastically in shuttle 1.

In FIG. 6, yarn feeler member 5 is provided with a stright upper edge 23 at its free part 6, whereas the embodiment shown in FIG. 7 has a thread guide shaped as an open recess 24 in its upper edge. As for the components of sensing insert 4 not shown in FIGS. 4 through 7, they may be shaped and arranged in a similar manner as illustrated and described with reference to FIGS. 1 through 3.

Other embodiments and modifications of the inventive monitoring devices are also comprised by the scope of the claims. By way of example, the front face of threader 3 adjacent yarn feeler member 5 may be recessed such as to receive the free part 6 of said feeler member 5 and to protect same from damage at the upper and lateral edges thereof. Induction coil 9 may be supported elastically at its periphery as in FIGS. 4 and 5, and, additionally, by means of a bolt 14 and locking ring 12, as illustrated in FIGS. 1 and 3, or mounted by other elastic members in shuttle 1.

What is claimed is:

1. A piezoelectric transducer device for monitoring yarn travel in a shuttle of a loom, wherein the shuttle has a front end provided with a threader having a thread inlet, said device comprising an integral assembly which includes an induction coil unit, a yarn feeler member mounted on one side of the induction coil unit for being vibrated by the traveling yarn, and a piezoelectric transducer element mechanically coupled with the yarn feeler member and operatively connected with the induction coil unit, wherein the improvement comprises:

the induction coil unit is shaped as a substantially flat unit having two major faces in substantially parallel relationship to one another;

the yarn feeler member is arranged as a unilaterally clamped flexural vibratory member comprising an arm disposed in substantially perpendicular relationship to said major faces of the induction coil unit and having a free end for contacting the traveling yarn; and means for directly and rigidly connecting the yarn feeler member and piezoelectric transducer element with one another.

2. The device as defined in claim 1, wherein the front end of the shuttle has a cutout, the induction coil unit is disposed in an area beneath the threader in said cutout in the front end of the shuttle, and said free end of the yarn feeler member is located adjacent said thread inlet of the threader.

3. The device as defined in claim 2, wherein a transverse wall is provided in the shuttle at the side of said assembly averted from the front end of the shuttle.

4. The device as claimed in claim 1, wherein the threader is provided at the side of the thread inlet with at least one projection protruding over said free end of the yarn feeler member.

5. The device as claimed in claim 1, wherein said induction coil unit is supported by a bolt protruding downwards from the threader and fixed to said bolt by releasable locking means.

6. The device as claimed in claim 5, wherein elastic material is provided between adjacent faces of the shuttle and the induction coil unit mounted thereto.

7. The device as claimed in claim 2, wherein said cutout is of substantially circular shape and provided with a circumferential groove, and the induction coil unit is surrounded with a peripheral elastic member tightly engaging said circumferential groove.

8. A piezoelectric transducer assembly for monitoring the yarn travel in a textile machine, comprising:

an induction coil unit shaped as a substantially flat unit having two flat faces in substantially parallel relationship to one another;

a yarn feeler member comprising a strip-shaped unilaterally clamped flexural vibratory member having a free end provided with yarn guiding means, said flexural vibratory member protruding from one of said flat faces of the induction coil unit near the circumference thereof in perpendicular relationship to said one flat face;

a piezoelectric transducer element;

means for rigidly connecting said piezoelectric transducer element with said yarn feeler element; and said yarn feeler member and piezoelectric transducer element are supported by the induction coil unit.

9. The assembly as defined in claim 8, wherein said yarn feeler member is a metal strip bent to an L-shaped configuration, and the yarn guiding means comprises an open recess.

10. The assembly as defined in claim 9, wherein one end of the L-shaped yarn feeler member is rigidly connected by said connecting means to the piezoelectric transducer element, and means for fixedly connecting the piezoelectric transducer element to the induction coil unit.

11. The combination with a shuttle for a loom, which shuttle has a front end provided with a threader having a thread inlet, of a piezoelectric transducer device for monitoring yarn travel in the shuttle, said piezoelectric transducer device comprising:

1. an integral assembly which includes:

a. an induction coil unit;

b. a yarn feeler member arranged to one side of the induction coil unit and vibrated by the traveling yarn;

c. a piezoelectric transducer element cooperating with the induction coil unit;

2. said induction coil unit comprising an essentially flat unit having two major faces disposed in substantially parallel relationship to one another;
3. means for directly and rigidly connecting the yarn feeler member and piezoelectric transducer element with one another;
4. means for connecting the piezoelectric transducer element with the induction coil unit;

5. said yarn feeler member being connected with said piezoelectric transducer element at one end thereof so as to provide a flexural vibratory member comprising an arm disposed in perpendicular relationship to said major faces of the induction coil unit and having a free end for contacting the traveling yarn.

* * * * *